US006522077B2

(12) United States Patent
Larkin

(10) Patent No.: US 6,522,077 B2
(45) Date of Patent: Feb. 18, 2003

(54) IONIZING ROD

(76) Inventor: William J. Larkin, 27 Parsons Dr., Swampscott, MA (US) 01907

( * ) Notice: Subject to any disclaimer, the term of this patent is extended or adjusted under 35 U.S.C. 154(b) by 3 days.

(21) Appl. No.: 09/855,938

(22) Filed: May 15, 2001

(65) Prior Publication Data

US 2002/0070673 A1 Jun. 13, 2002

Related U.S. Application Data

(60) Provisional application No. 60/204,355, filed on May 15, 2000.

(51) Int. Cl.[7] ..... H05B 31/26; H05F 3/00
(52) U.S. Cl. ..... 315/111.91; 361/222
(58) Field of Search ..... 315/111.91; 361/212, 361/220, 222, 225, 226

(56) References Cited

U.S. PATENT DOCUMENTS 3,585,447 A * 6/1971 McLain ..... 361/218
4,672,825 A 6/1987 Yasukawa et al. ..... 66/194
5,501,899 A * 3/1996 Larkin ..... 361/212
5,508,879 A 4/1996 Kitamura et al. ..... 361/221
5,690,014 A * 11/1997 Larkin ..... 57/901
5,691,875 A * 11/1997 Dangelmayer et al. ..... 361/220
5,740,006 A 4/1998 Larkin ..... 361/213

* cited by examiner

*Primary Examiner*—Don Wong
*Assistant Examiner*—Thuy Vinh Tran
(74) *Attorney, Agent, or Firm*—Perkins, Smith & Cohen, LLP; Jerry Cohen; Peter J. Borghetti

(57) ABSTRACT

An ionizing rod comprising a core having an outer surface with a plurality of ionizing points disposed along the outer surface of the core. The plurality of ionizing points are sufficiently dense upon the core surface such that air between the plurality of ionizing points and an object is sufficiently ionized to remove static charge from the object. The core material can be electrically conductive, insulative, or static dissipative. The methods to attach the ionizing points to the core include a pullover sleeve, made of fibers including ionizing points, and glue to adhere either fibers in electrical communication or not in electrical communication depending on whether conductive or non-conductive adhesive are employed. Alternative embodiments include a device for the ionizing charged particles to travel to ground or electrically charged and a grip.

23 Claims, 2 Drawing Sheets

IONIZING ROD

CROSS REFERENCE TO RELATED APPLICATIONS

This application claims priority of Provisional Application No. 60/204,355, entitled IONIZING ROD filed on May 15, 2000, and which is incorporated herein by reference.

BACKGROUND OF THE INVENTION

The present invention relates to static eliminating devices, and particularly relates to such devices having a multiplicity of microfiber ionizing points.

In the fabrication of molded articles, particularly large, polymeric and polymer composite articles such as boats, car parts, bathroom shower stalls, furniture and the like, the articles are "laid up" on a mold and cured. In releasing of one of these articles from the mold, static electricity is produced which causes problems such as attraction of dust and dirt, sparks, and discharges. A human operator approaching the mold and composite can receive a painful shock from such a discharge. Further, the high residual charge on the surfaces of the insulative mold material attracts dust and dirt, often requiring time consuming and costly cleaning and recleaning of the mold surface. Conventional static eliminators have not proven adequate to control these problems because of the static levels and large size of the molds and composite parts.

Also, in the finishing or painting of large polymeric and polymer composite articles, it is necessary to completely remove dust and other particles from the surface of the article, since even small particles will be visible under the coating, particularly a clear coating. Normally, such article surfaces are wiped (tacked) with clean cloths to remove the dust and other particles from the surface. This wiping procedure can generate a large static charge on the surface being wiped. The static charge thus generated can, in turn, re-attract particles to the surface of the article before the coating can be applied. Again, conventional static eliminators are not adequate to remove these static charges because of the amount of static and the size of the surface. Also, the need for mobility of the operator renders conventional static eliminators impractical due to their need to be electrically connected to a power source.

Another problem is caused by static charges developed on winder and slitter machines used in the plastic and paper converting industry. As the plastic or paper materials are wound on rolls at high speed, very high static charges are generated. A human operator approaching and contacting the rolls is often subjected to painful discharge of static electricity from the rolls. Also, the high static charge attracts dust and dirt to the rolls. Conventional static control devices have provided only limited control of these problems. It would be useful in this industry to reduce the static charge sufficiently to eliminate dust attraction, preferably below 2 KV.

Accordingly, it is an object of the present invention to provide an ionizing rod that overcomes the disadvantages of the prior art.

It is another object of the invention to provide an ionizing rod including a multiplicity of ionizing points, to ionize the air between its surface and the statically charged object.

It is an alternative object of the invention to provide an ionizing rod including a multiplicity of ionizing points, to ionize the air between its surface and the statically charged object.

It is another object of the invention to provide such an ionizing rod that may be readily carried by a human operator.

It is another object of the invention to provide such an ionizing rod that is flexible, lightweight and easily handled by a human operator.

SUMMARY OF THE INVENTION

The present invention is an ionizing rod comprising a core having an outer surface with a plurality of ionizing points disposed along the outer surface of the core. The plurality of ionizing points are sufficiently dense upon the core surface such that air between the plurality of ionizing points and an object is sufficiently ionized to remove static charge from the object.

The core material can be electrically conductive, insulative, or static dissipative. The selection of the appropriate core material depends on the application of the present invention. Once the material is selected, the appropriate method to attach the ionizing points to the core is then determined.

The methods to attach the ionizing points to the core include a pullover sleeve, made of microfibers including ionizing points, and glue to adhere either microfibers in electrical communication or not in electrical communication depending on whether conductive or non-conductive adhesive are employed.

Alternative embodiments include a means for the ionizing charged particles to travel to ground or electrically charged and a grip.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

In one exemplary embodiment, an ionizing rod includes an insulative core around which a conductive sleeve of small diameter ionizing static control strands is disposed. The insulative core is flexible, e.g., a rod or a wire or a cord, and is adaptable to be grounded or electrically charged, and preferably includes an insulating grip at its proximal end for handling by a human operator.

Figure 1:
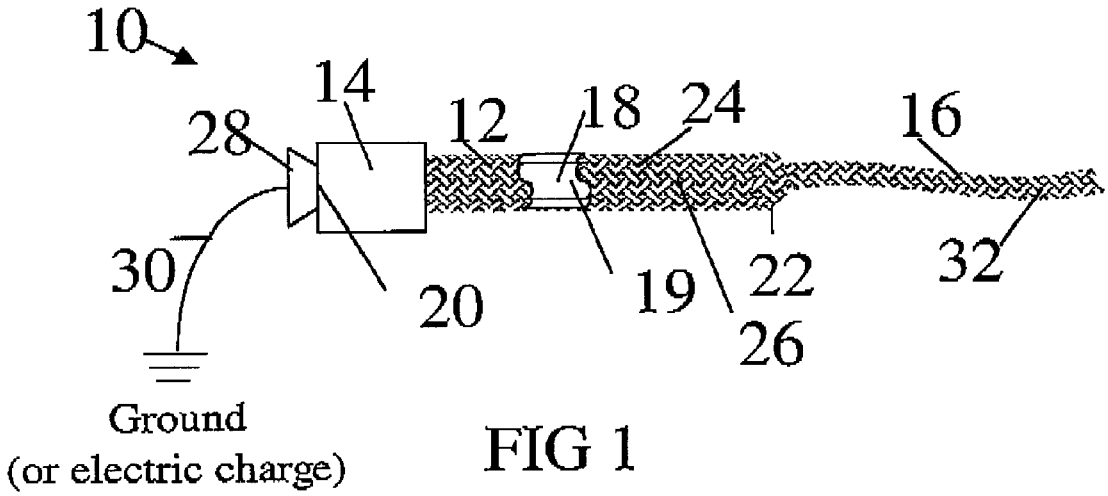
FIG. 1 is a pictorial view of an ionizing rod in accordance with one embodiment of the present invention.
Figure 3:
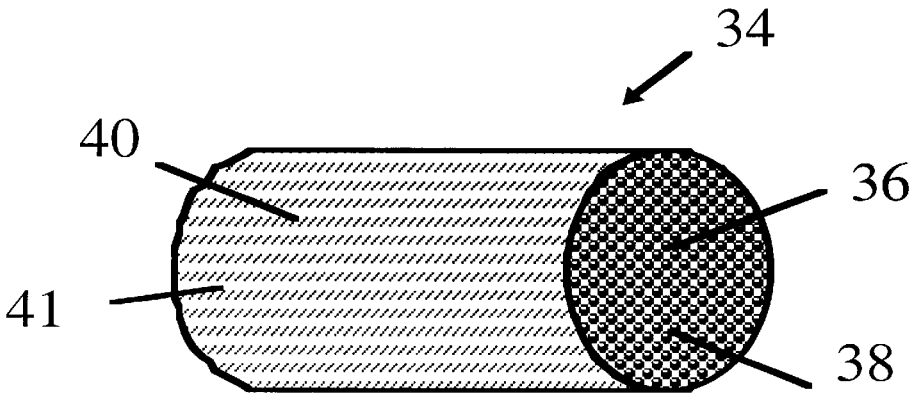
FIG. 3 illustrates a cross-section of ionizing strand including soft fibers twisted together with electrically conductive microfibers having a multiplicity of ionizing points provided by ends of and bends in each microfiber.

Referring now to FIGS. 1 and 3, an ionizing rod 10 in accordance with one embodiment of the present invention includes rod portion 12, grip 14, and ionizing whip portion 16. Rod portion 12 includes an insulative core 18 and an conductive sleeve 24 of individual ionizing points 40. A plurality of ionizing points 40 (FIG. 3) are sufficiently dense upon the conductive sleeve 24 such that air between the plurality of ionizing points and a statically charged object is sufficiently ionized to remove static charge from the object.

The insulative core 18 also includes an outer surface 19, a proximal end 20 and distal end 22.

An insulative core 18 is preferred over suitable alternative conductive and static dissipative cores for reasons of cost and operator safety. With an insulative core 18, the operator is only in contact with the insulative core 18 and is electrically isolated from the conductive sleeve 24, which is grounded separately. Such that, if the ground became separated, or if the rod was to contact a live electrical circuit, the operator would not become the path of least resistance for the ionizing charge traveling to ground. An insulative core 18 is made of material selected from a group consisting of plastic, other polymers, or wood.

The terms insulative, conductive, and static dissipative are known to those skill in art of static electricity. Insulative means non-conductive and has an electrical surface resistivity of >10E12 ohms per square per ASTM D 257. Conductive means a surface resistivity of <10E5 per ASTM D 257. Static Dissipative means a surface resistivity between 10E5 and 10E12 per ASTM D 257. Though, an insulative core is preferred, a conductive core and a static dissipative core are functional, acceptable alternatives, and are discussed in detail below.

A conductive core is appropriate where the ionizing points on the conductive sleeve need to be grounded separately to the core. Examples include where the ionizing points are not in electrical communication with each other or where the conductive sleeve does not reach the grounding means and the conductivity of the core provides a convenient path to ground or to a grounded operator. Also, conductive materials, such as conductive graphite or carbon cores, are lighter and stronger than insulative core materials and provide desirable rigidity or flexibility for the application of the rod.

A static dissipative core is appropriate where a more controlled slower discharge of voltage through the operator or to ground is desirable. A static dissipative core is made of material selected from a group consisting of plastic polymers, coated or treated polymers, metals, carbons, or wood.

The preferred method to attach the ionizing points 40 to the insulative core 18 is a pullover conductive sleeve 24. The conductive sleeve 24 is a mesh woven from a plurality of ionizing static control strands 34, illustrated in FIG. 3, and is sized to tightly, but removably, fit over the core. The details of an ionizing static control strand 34 are described in U.S. Pat. No. 5,690,014 and incorporated by reference herein. The ionizing static control strand 34 includes a conventional, non-electrically conductive fibrous material 36 and a sufficient number of electrically conductive microfibers 38 twisted together to provide a multiplicity of ionizing points 40 for static removal. Preferably, at least ⅔ of the surface of ionizing static control strand 34 is provided by the conventional, non-electrically conductive fibrous material 36 to provide a non-abrasive surface to prevent scratching of the objects. The conventional, non-electrically conductive fibrous material 36 are non-electrically conductive fibers, e.g., cotton, nylon, or other polymeric fiber. The electrically conductive microfibers 38 are in electrical communication with one another along the length of the ionizing static control strand 34. The electrically conductive microfibers 38 provide a multiplicity of ionizing points 40 disposed along the length of the strand 34 and exposed at or extending minimally above the outer surface 41 of the ionizing static control strand 34.

Thus, when the ionizing static control strand 34 is electrically grounded (or, alternatively, electrically charged), air between the ionizing points 40 and a statically charged object adjacent to or contacting the outer surface of the ionizing rod 10 is sufficiently ionized to remove static charge from the object.

The electrically conductive microfibers 38 of the ionizing static control strands 34 typically are about 0.5 to 50 microns in diameter and about 2–8 cm long. Electrically conductive microfibers 38 of a diameter less than 40 microns are greatly preferred because the small diameter ionizes efficiently in a voltage field and to prevent scratching of the objects on which they are used. Preferred conductive materials for the electrically conductive microfibers 38 include carbon, metal-coated carbon, copper, stainless steel, metal-coated acrylic, metallized acrylic, or electrically conductive polymers.

Figure 4:
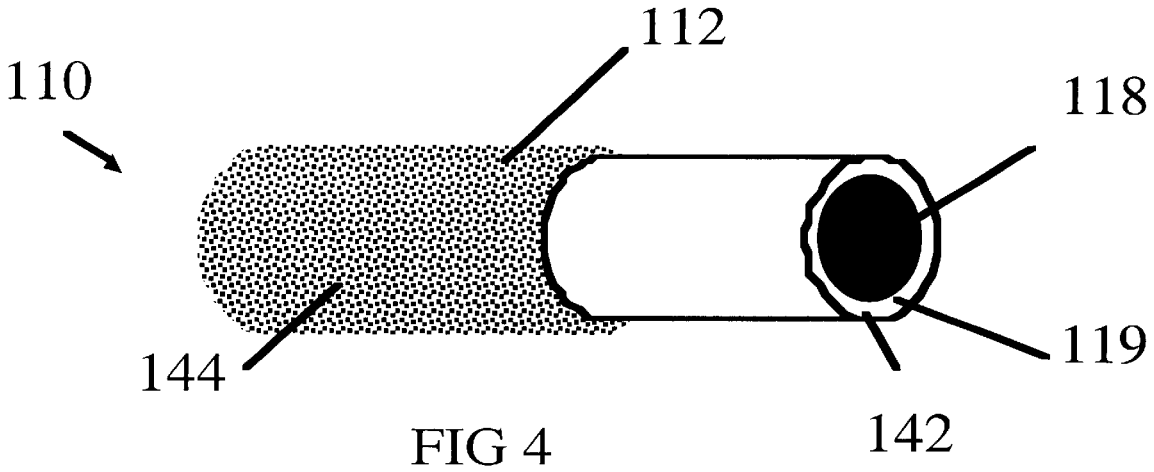
FIG. 4 is an exploded view of a portion of an ionizing rod in accordance with an alternate embodiment of the invention.

An alternative method to attach the ionizing points 40 to a core includes an adhesive. In one exemplary embodiment 110 is illustrated in FIG. 4. An ionizing rod portion 112 includes an electrically conductive core 118. Electrically conductive adhesive 142, bonds a multiplicity of electrically conductive microfibers 144 to the outer surface 119 of the electrically conductive core 118. Electrically conductive microfibers 144 provide the above-described multiplicity of ionizing points 40 at the surface of the ionizing rod 10 to remove static.

Electrically conductive adhesive is employed by known flocking methods where the network of multiplicity of electrically conductive microfibers 144 are not in electrical communication with each other. The conductive glue acts as the conductive path to transfer the voltage to ground either to a conductive core or a static dissipative core or directly to a ground connector.

Non-conductive adhesive is employed where the network of electrically conductive microfibers 144 are in electrical communication with each other. Here, the electrically conductive microfibers 144 overlap each other to span the entire length of the core, thereby conducting the voltage directly to a ground connector. The non-conductive glue only acts as an adhesive to adhere the ionizing static control strands 34 to the core.

Based on the alternative embodiment illustrated in FIG. 4, additional embodiments are possible with the various combinations of cores, adhesives, ionizing point networks, and grounding methods. A few examples are provided in Table 1:

TABLE 1

| Core | Adhesive Type | Ionization Point Network | Grounding |
|---|---|---|---|
| insulative | Conductive | ionizing points not in direct electrical communication | Clamp Grounding connector to Conductive adhesive |
| insulative | non-conductive | ionizing points in direct electrical communication | Clamp Grounding connector to ionizing points |
| static dissipative | Conductive | ionizing points not in direct electrical communication | Clamp Grounding connector to Conductive adhesive |

As illustrated in FIG. 1, the preferred embodiment includes an ionizing whip portion 16 conveniently provided by extending the conductive sleeve 24 distally beyond distal end 22 of insulative core 18 for more adaptable static control on, e.g., irregular surfaces. The ionizing whip portion 16 is more tightly woven than the conductive sleeve 24 to form an ionizing cord 32 (discussed in detail below), as described in U.S. Pat. No. 5,690,014, incorporated by reference herein. Alternatively, a separate ionizing whip portion (not shown) may be attached directly to a conductive core or a dissipative core or conductive sleeve 24 to electrically communicate therewith. This separate whip portion may be fabricated from, e.g., a length of the above-described ionizing cord.

An ionizing cord 32 is fabricated by braiding or twisting together a plurality of ionizing static control strands 34, at least one of which is an above-described electrically conductive microfibers 38. A multiplicity of the ionizing points 40 of the one or more ionizing static control strands 34 of each cord are disposed along the length of the cord and are exposed at or extend minimally above the outer surface of the cord. The electrically conductive microfibers 38 of each ionizing static control strand are in electrical contact with the electrically conductive core or static dissipative core or conductive adhesive of the ionizing rod 10.

Figure 2:
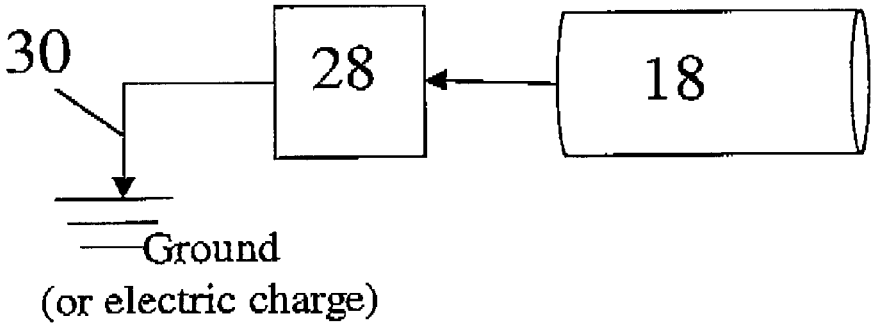
FIG. 2 is a block diagram of the electrical circuit to either ground the ionized particles or electrically charge the ionized particles to neutralize the charge.

In alternative embodiments, the ionizing rod 10 is grounded at its proximal end 20 by electrically connecting it, e.g., by way of a wire or coiled wire or an extension of the conductive sleeve 24, to a conventional grounding means, e.g., by draping a length of wire or ionizing cord (discussed in detail below) to contact a grounded floor mat. As illustrated in FIGS. 1 and 2, the ionizing rod 10 is electrically connectable to ground via a connector 28 and a lead wire 30. The connector 28 is a common, commercially available electrical connector that is placed over the proximal end of the rod and crimped, thereby capturing the sleeve 24 and insulative core 18, or a conductive core (not shown), or a dissipative core (not shown). The lead wire 30 is also commercially available and in electrical communication with the connector 28 and the ground or an electrical charging means for balancing the ionized particles. In applications in which the charge is minimal, the grounding means may be the human operator, who may act as an ungrounded reservoir for the charge. Alternatively, the operator may be conventionally grounded, e.g., using a heel or wrist strap or a conductive mat. In applications where the static charge is greater, the rod is provided with an insulating grip at its proximal end to protect the operator from the discharge.

The preferred grip 14 is an insulative grip for reasons of cost and for operator safety. Alternative grips include a conductive grip, where the ionizing rod must be connected to a grounded operator, and a static dissipative, where slow grounding is a key objective.

Alternative embodiments include a means for neutralizing the ionizing charged particles by an electrical charge.

Also alternatively, ionizing points may be inscribed, machined, extruded, or molded into the surface of an electrically conductive rod to provide similar static charge control (not shown). However, the conductive sleeve-core combination described above is greatly preferred, since in this combination the conductive sleeve is readily removable and replaceable should it become worn or contaminated.

MODE OF OPERATION

Below are two examples of typical modes of operation of the present invention. These examples are presented for illustrative purposes and are not intended to limit the invention.

An operator approaches a static electrically charged object, e.g., a large plastic object released from a fiberglass mold that created a very high static charge when the two objects were separated. The fiberglass mold and the molded part are wiped across their surface with the ionizing rod to neutralize most of the surface static charge to stop the attraction of dust. As the ionizing rod is brought near, within a few inches, the charged surfaces, the conductive microfiber ionizing points along the outer surface of the ionizing rod cause the voltage to ionize. The ionized charge is carried to ground via the conductive fibrous sleeve connected to a grounding connector at the end of the rod, which in turn is connected to a lead wire to carry the charges to earth ground. Because of the high static voltages, an insulative grip electrically separates the operator from the ionization to ground process. The ionizing rod ionizes the charges to ground without sparking and renders the surfaces free of high static so they not only do not spark to them but also, they stop attracting dust.

An operator approaches a stack of rigid styrene sheets that must be lifted one by one and placed on a screen-printing machine. A high static charge develops as an operator separates each sheet from the stack. This action not only causes dust to attract to the sheet and stack, but also causes the operator to be statically charged resulting in a painful static discharge to the metal surface of the screen-printing machine. As the operator lifts the sheet from the stack, the ionizing rod is placed between the rising sheet and the stack. The conductive ionizing points cause the static charge on the sheet and the stack to ionize. The ionized charge is carried to ground via the conductivity of the fibrous sleeve to the hand of the operator by direct contact or via a static dissipative handle. In turn, the operator is grounded to the concrete floor or to a static dissipative mat using a simple grounding heel strap.

The invention described herein presents to the art novel, improved ionizing rod for static control. The ionizing rod provides improved static control, is manufactured using an inexpensive process and materials, and is readily provided with a fresh ionizing surface when damaged or contaminated.

While there has been shown and described what are at present considered the preferred embodiments of the invention, it will be apparent to those skilled in the art that modifications and changes can be made therein without departing from the scope of the present invention.

The description of various illustrative embodiments shown in the Drawings refers to the type of ionizing rod described above. However, it is not intended to limit the scope of the present invention, but merely to be illustrative and representative thereof.

What is claimed is:

1. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said plurality of ionizing points are fixedly attached to said outer surface of said core by an adhesive, said adhesive being made of material selected from the group consisting of electrically conductive, insulative, or static dissipative.

2. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said plurality of ionizing points are removably attached to said outer surface of said core.

3. The ionizing rod as recited in claim 2, wherein said plurality of ionizing points are woven into a sleeve, said sleeve is sized to fit over said core.

4. The ionizing rod as recited in claim 3, wherein said sleeve extends outward beyond said distal end of said core.

5. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said rod further comprises grounding means for transferring ionized particles to ground, said grounding means is attached to said core.

6. The ionizing rod as recited in claim 5, wherein said grounding means includes a connector removably attached to said proximal end of said core.

7. The ionizing rod as recited in claim 6, wherein said grounding means further includes a lead wire fixedly removably attached to said connector.

8. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said rod further comprises electrical charging means for neutralizing ionized particles, said electrical charging means is attached to said core.

9. The ionizing rod as recited in claim 8, wherein said electrical charging means includes a connector removably attached to said proximal end of said core.

10. The ionizing rod as recited in claim 9, wherein said electrical charging means further includes a lead wire removably attached to said connector.

11. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said rod further comprises a grip.

12. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said core is made of electrically conductive material.

13. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said core is made of insulative material.

14. An ionizing rod comprising:

a core having an outer surface, a distal end, and a proximal end; and a plurality of ionizing points, said plurality of ionizing points being disposed along said outer surface of said core, thereby air between said plurality of ionizing points and an object is sufficiently ionized to remove static charge from the object, wherein said core is made of static dissipative material.

15. An ionizing rod comprising, a rod portion, said rod portion having a proximal end, a distal end, and an electrically conductive core; and a conductive sleeve removably attached to said electrically conductive core, said conductive sleeve is woven from material with a plurality of ionizing points, whereby air between said plurality of ionizing points and an object is sufficiently ionized to remove static charge from the object.

16. An ionizing rod comprising, a rod portion, said rod portion having a proximal end, a distal end, and an insulative core; and a conductive sleeve removably attached to said insulative core, said conductive sleeve is woven from material with a plurality of ionizing points, whereby air between said plurality of ionizing points and an object is sufficiently ionized to remove static charge from the object.

17. An ionizing rod comprising, a rod portion, said rod portion having a proximal end, a distal end, and an static dissipative core; and a conductive sleeve removably attached to said static dissipative core, said conductive sleeve is woven from material with a plurality of ionizing points, whereby air between said plurality of ionizing points and an object is sufficiently ionized to remove static charge from the object.

18. An ionizing rod comprising, a rod portion, said rod portion having a proximal end, a distal end, and an electrically conductive core;

an electrically conductive adhesive layer, said electrically conductive adhesive layer is adhered to said electrically conductive core; and a plurality of conductive microfibers adhered to said electrically conductive adhesive layer, said plurality of conductive microfibers are in electrical communication with said electrically conductive core, wherein said plurality of conductive microfibers provides a plurality of ionizing points, whereby air between said plurality of ionizing points and an object is sufficiently ionized to remove static charge from the object.

19. An ionizing rod comprising, a rod portion, said rod portion having a proximal end, a distal end, and an insulative core;

an electrically conductive adhesive layer, said electrically conductive adhesive layer is adhered to said insulative core; and a plurality of conductive microfibers adhered to said electrically conductive adhesive layer, wherein said plurality of conductive microfibers provides a plurality of ionizing points, whereby air between said plurality of ionizing points and an object is sufficiently ionized to remove static charge from the object.

20. An ionizing rod comprising, a rod portion, said rod portion having a proximal end, a distal end, and a static dissipative core;

an electrically conductive adhesive layer, said electrically conductive adhesive layer is adhered to said static dissipative core; and a plurality of conductive microfibers adhered to said electrically conductive adhesive layer, said plurality of conductive microfibers are in electrical communication with said static dissipative core, wherein said plurality of conductive microfibers provides a plurality of ionizing points, whereby air between said plurality of ionizing points and an object is sufficiently ionized to remove static charge from the object.

21. An ionizing rod comprising, a rod portion, said rod portion having a proximal end, a distal end, and an insulative core;

an non-conductive adhesive layer, said non-conductive adhesive layer is adhered to said insulative core; and a plurality of conductive microfibers in electrical communication with each other adhered to said non-conductive adhesive layer, wherein said plurality of conductive microfibers provides a plurality of ionizing points, whereby air between said plurality of ionizing points and an object is sufficiently ionized to remove static charge from the object.

22. A static electricity ionizing apparatus comprising, air ionizing means for ionizing air between said apparatus and an object, thereby neutralizing charged particles along a surface of a statically charged object, wherein said air ionizing means comprises a core having a proximal end and a distal end, and a conductive sleeve removably attached to said core, said conductive sleeve is woven from material with a plurality of ionizing points; and grounding means for transferring charged particles ionized by said air ionizing means to ground, whereby air between said plurality of ionizing points and the statically charged object is sufficiently ionized to remove static charge from the statically charged object.

23. A static electricity ionizing apparatus comprising, air ionizing means for ionizing air between said apparatus and an object, thereby neutralizing charged particles along a surface of a statically charged object, wherein said air ionizing means comprises a core having a proximal end, a distal end, and a predetermined length, an adhesive layer substantially coating said predetermined length of said core, and a plurality of conductive microfibers adhered to said adhesive layer, wherein said plurality of conductive microfibers provides a plurality of ionizing points; and grounding means for transferring charged particles ionized by said air ionizing means to ground, whereby air between said plurality of ionizing points and the statically charged object is sufficiently ionized to remove static charge from the statically charged object.

* * * * *